United States Patent [19]

Goetz

[11] Patent Number: 4,614,322

[45] Date of Patent: Sep. 30, 1986

[54] STRAPPING AND HANGING DEVICE

[76] Inventor: George E. Goetz, 5822 Elwynn Dr., Milford, Ohio 45150

[21] Appl. No.: 657,976

[22] Filed: Oct. 5, 1984

[51] Int. Cl.[4] ..... A47G 1/16

[52] U.S. Cl. ..... 248/490; 248/488; 248/359; 248/359.1; 24/528

[58] Field of Search ..... 248/359 F, 490, 488, 248/448, 491, 222.4, 359.1; 24/522, 523, 527, 528, 585, 16 PB

[56] References Cited

U.S. PATENT DOCUMENTS

| | | | |
|---|---|---|---|
| 1,663,621 | 3/1928 | Bowman | 24/585 |
| 2,066,957 | 1/1937 | Wratschko | 24/522 |
| 2,150,709 | 3/1939 | Bake | 24/528 |
| 2,209,972 | 8/1940 | Horwitt | 248/490 |
| 2,810,226 | 10/1957 | Horwitt | 248/490 |
| 3,581,347 | 3/1970 | Verspieren | 248/743 |
| 4,223,864 | 9/1980 | Harlow | 248/490 |
| 4,470,824 | 9/1984 | Huret | 248/359 F |

FOREIGN PATENT DOCUMENTS

| | | | |
|---|---|---|---|
| 801785 | 12/1950 | Fed. Rep. of Germany | 248/491 |
| 1529366 | 5/1969 | Fed. Rep. of Germany | 248/488 |
| 2313136 | 9/1974 | Fed. Rep. of Germany | 248/491 |
| 732067 | 6/1955 | United Kingdom | 248/359.1 |

*Primary Examiner*—Reinaldo P. Machado
*Assistant Examiner*—Alvin Chin-Shue
*Attorney, Agent, or Firm*—Frost & Jacobs

[57] ABSTRACT

A device for adjustable and releasable strapping or binding of objects, particularly plates held for display. The binding feature of the present invention involves a toothed strap held in place by a releasable clasp. The plate holding feature of the present invention provides hooks for grasping the periphery of a plate and provides an adjustable strap for holding those hooks snugly in place. The resulting device firmly holds the plate without obstructing a clear view of it.

7 Claims, 15 Drawing Figures

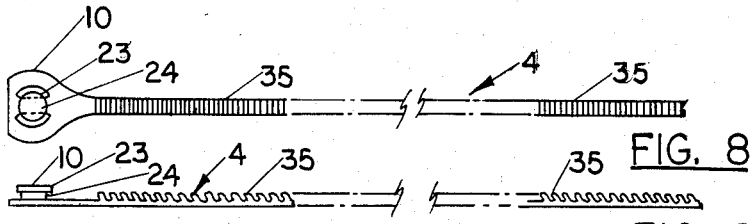
FIG. 8
FIG. 7
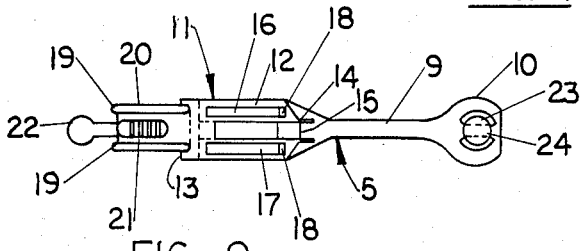
FIG. 9
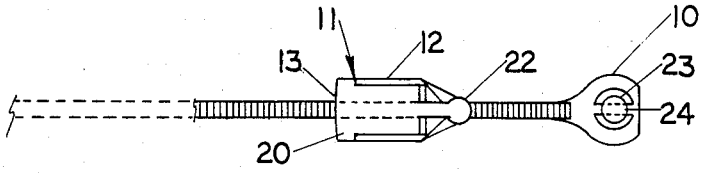
FIG. 11
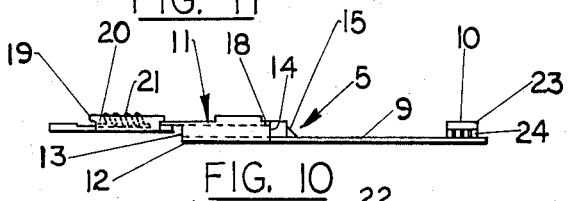
FIG. 10
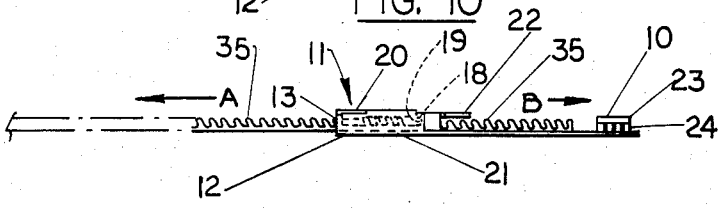
FIG. 12

STRAPPING AND HANGING DEVICE

BACKGROUND OF THE INVENTION

The present invention relates to a device and method for securing and strapping an object and, more particularly, to methods for gripping and hanging items for display such as plates. One embodiment of the present invention can be used in any application where a means for binding or strapping is required. Another embodiment of the present invention applies in the more particular situation of hanging a flat item such as a plate for display. The applicant is unaware of prior art patents relating to the present invention.

In many locations such as stores, museums and china cabinets, it is desirable to display plates by hanging them from a vertical surface or by holding them in an erect fixture. In either application, the central problem is how to hold the plate without obstructing a clear view of its pattern and features.

A related problem arises when dealing with variations in plate sizes. Because the diameters of plates for display may vary widely, a plate hanging device ideally should provide for securing means which are variable in length. If the securing means is a strap of some sort, the result is a variable length strapping or binding means. With such strapping means, the ability to insure that the straps will not loosen while at the same time providing quick application and release of such strapping is of great benefit.

SUMMARY OF THE INVENTION

The present invention provides, in one embodiment, a toothed strap and clasp which may be used in a variety of applications. Items may be bound with the strap which is then held securely by a clasp. After use, the clasp may be released easily and the strap removed. A second embodiment of this adjustable, releasable strap is also provided by the present invention. This embodiment provides an adjustable plate hanging device used to display plates in a fixture or from a vertical surface. The attachment device comprises hook elements which hold the edge of the plate. Each hook element is releasably connected to a strap. One of these straps is toothed across most of its length and the other has attached a means for clasping the toothed strap. In this manner, the second embodiment provides a hanging device adaptable to a broad range of dimensions by an adjustable strap and clasp member as previously described.

BRIEF DESCRIPTION OF THE DRAWINGS

FIGS. 7 and 8 are a side view and top view, respectively, of a toothed strap.

FIGS. 9 and 10 are a top view and side view, respectively, of a clasping strap.

FIGS. 11 and 12 are a top view and side view, respectively, of a clasping strap closed in latched position over a toothed strap.

DESCRIPTION OF THE PREFERRED EMBODIMENTS

Figure 1:
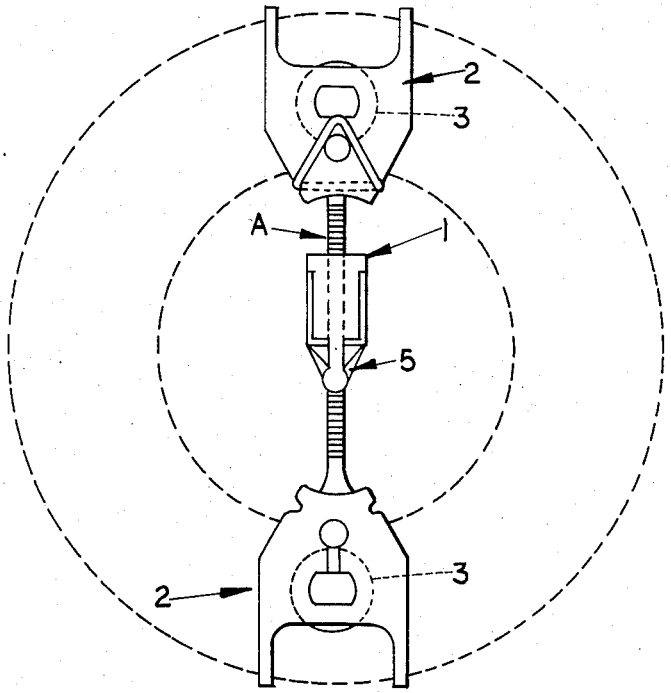
FIG. 1 is an assembly view of a plate hanging device of the present invention applied to a plate shown in phantom lines.

FIG. 1 shows the use of the hanging device 1 applied to a plate shown in phantom lines. Hook elements indicated generally at 2 grip the plate edges and are pulled toward each other by a toothed strap indicated generally at 4 and a clasping strap indicated generally at 5. Cushion buttons 3 press against the back of the plate to hold the hook elements 2 snugly against the plate circumference. The hook elements 2 are releasably attached to a toothed strap 4 and a clasping strap 5 by releasable attachment means described in greater detail below. The cushion buttons 3 provide the additional function of maintaining attachment of the toothed strap 4 and clasping strap 5 to their respective hook elements 2.

Figure 2:
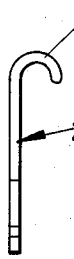
FIGS. 2 and 3 are a side view and elevation view, respectively, of a hook element.
Figure 3:
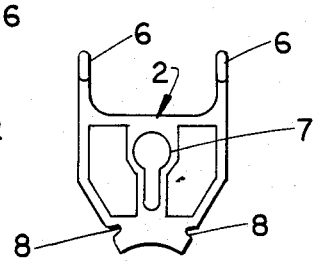
Figure 4:
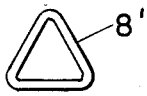
FIG. 4 is a side view of a flexible hanger.

FIGS. 2 and 3 illustrate the geometry of the hook elements. Each hook element is provided with at least two fingers 6 which describe an arc greater than 90° from the central body plane and curve around the edge of a plate to grip it as illustrated in FIG. 1. The central body of each hook element 2 is provided with a keyhole shaped perforation 7 centered on the axis of symmetry of the hook element. The keyhole-shaped perforation is used to engage the means for attaching the toothed strap 4 and the clasping strap 5 to their respective hook elements in a manner described below. As seen in FIG. 3, the hook element edges extending away from the fingers are substantially parallel for an unspecified length then curve to a V-shape which ultimately terminates in an edge opposite the edge from which the fingers depend. Each hook element is also provided with substantially semi-circular indentations or recesses 8 in the V-shaped edges to accommodate an O-ring or flexible triangular strap 8' (FIG. 4) for mounting the hanging device to a wall hook. As will be appreciated by those skilled in the art, the geometry of the hook element profile could deviate greatly from that described above without affecting the function of the element or departing from the spirit of the invention.

FIGS. 9 and 10 illustrate the clasping strap indicated generally at 5 in FIG. 1. The strap is comprised of a smooth section 9, a means 10 for attachment to a hook element 2 and a clasping chamber 11. The clasping chamber comprises a box-like structure 12 with holes centered in end walls 13, 14, and 15 through which the toothed strap can pass. The clasping chamber 11 contains two longitudinal depressions 16 and 17 on each side of the holes with undercuts 18 adjacent end wall 14 which allow locking tabs 19 of a cap 20 to be snapped securely into place. Cap 20 is pivotally connected to the upper edge of end wall 13 of the clasping chamber 12, and carries teeth 21 on a central strip through the middle of its underside. These teeth engage with the teeth of a toothed strap shown in FIGS. 7 and 8 when the toothed strap is inserted through the holes in clasping chamber 12, as illustrated in FIGS. 10, 11 and 12. The cap 20 also has attached a projecting tab 22 which allows the cap to be lifted manually from a snapped position to an open position.

Figure 5:
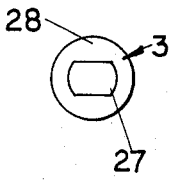
FIGS. 5 and 6 are a side and elevation view, respectively, of a cushion button.
Figure 6:
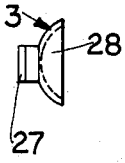

FIGS. 7 and 8 show the toothed strap 4. At one end, the strap terminates in an attachment means 10 identical to that of the clasping strap, like parts having like reference numerals. This attachment means consists of a disc 23 which is held above the strap by a bar shaped member 24. With attachment means 10, the strap is releasably attached to the main body of a hook element 2 by passing the disk 23 through the circular portion of the keyhole perforation 7, then moving the strap relative to the hooking element such that the bar shaped member 24 slides into the narrower portion of the keyhole shaped perforation 7. The attachment means is then held in this position by inserting a cushion button 3 in the circular portion of the keyhole-shaped perforation. The cushion button, illustrated generally at 3 in FIGS. 5 and 6, resembles a suction cup portion, shown at 28, with a tab 27 centrally attached to its convex side. Tab 27 is made of a pliable material and has a diameter slightly larger than the circular portion of the keyhole-shaped perforation. Thus, the tab 27 of the cushion button 3 can be forced through the circular portion of the keyhole-shaped perforation and prevent the attachment means 10 of the toothed strap 4 and the clasping strap 5 from disengaging the hook elements 2.

FIGS. 11 and 12 illustrate the engagement of the clasping strap to the toothed strap. As will be apparent to one skilled in the art, it is important that the clasping member not release the toothed strap when subjected to tensile forces as indicated in FIG. 12 by arrows A and B. In this embodiment of the present invention, resistance against release is provided by the orientation of the cap 20 and the shape of the interlocking teeth 21 of clasping chamber 12 and teeth 35 of the toothed strap. As shown in FIG. 12, the tooth surfaces of the toothed strap are inclined upward towards the direction of force A. Conversely, the teeth 21 of the cap 20 are inclined downward at compatible angles toward force B. With this configuration, forces A and B have two effects. First, the tooth surface angles of the teeth 35 of the toothed strap tend to securely engage the teeth 21 of cap 20. Second, any resulting distortion caused by forces A and B to the cap 20 or the overall clasping chamber indicated generally at 11 will tend to force tab 19 further under lip 18 ensuring positive engagement of the clasping device. These effects are obtained when one side of each tooth is between 80° and 90° from the plane of the strap when measured from the side adjacent the attachment means and the other side of each tooth is between 50° and 60° when measured in the same manner. In addition, the carefully controlled radius of each tooth 35 allows clearance between the interlocking teeth when the cap 20 is being moved into a closed position. This radius is preferably between 0.01 and 0.02 inch.

Figure 13:
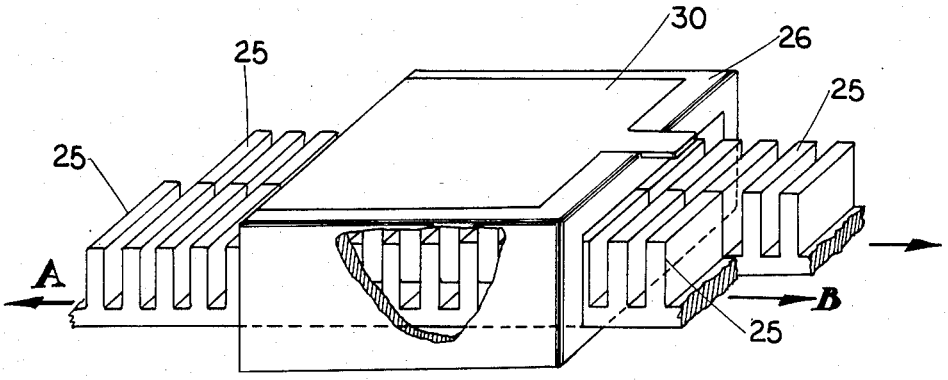
FIG. 13 is a perspective view of a strapping device according to the present invention.

Another embodiment of the present invention is found in FIG. 13 which shows application of a clasp designed for use with strapping or binding. In this embodiment, a single toothed strap 25 of indefinite length is wrapped or hooked around an object and the two free ends of the strap are inserted side-by-side into and through a clasping chamber 26. The clasping chamber 26 is then closed with a pivotally attached cap 30 similar to cap 20 of the previous embodiment so that the teeth on the underside of the clasping chamber cap 30 engage the teeth of the strap 25. Locking tabs, mating undercuts and means for pulling the cap from a closed position are provided as in FIGS. 9, 10, 11 and 12. The free ends of the strap projecting in opposite directions from the clasping chamber then may be trimmed for a neat appearance. In this manner, the strap 25 is held snug with the option to later release it.

As in the previously described embodiment, it will be apparent to one skilled in the art that the clasping member of the present embodiment must be designed to maintain its grip on the toothed strap while being subjected to tensile forces as shown at A and B in FIG. 13. This objective must be accomplished differently with the embodiment of FIG. 13 than with the previously described embodiment because a side-by-side arrangement of the ends a circular loop of a toothed strap with slanted teeth as provided in the previously described embodiment would result in side-by-side rows of teeth, all slanted in the same direction. Because the tensile forces A and B are in opposite directions, such an arrangement would yield resultant forces between the strap teeth and a mating set of slanted teeth of cap 30 tending to securely engage the teeth of one strap with the cap teeth but tending to disengage the teeth of the other strap from the cap teeth. To remedy this problem this embodiment of the present invention provides a toothed strap on which each side of each tooth 25 is perpendicular to the plane of the strap and parallel to each other side of each tooth. With this configuration, the resultant forces developed between mating tooth surfaces will not tend to disengage the cap teeth from either set of strap teeth.

Figure 14:
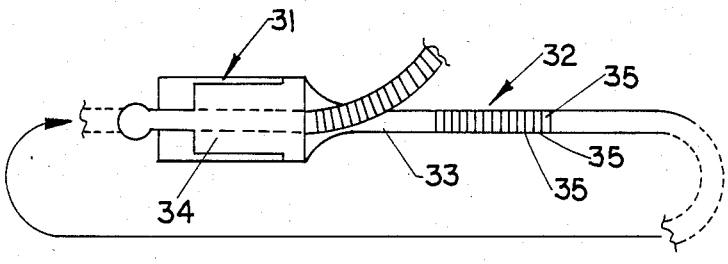
FIGS. 14 and 15 are a top view and side view, respectively, of a strapping device according to the invention wherein a toothed strap and a clasping chamber are an integral unit.
Figure 15:
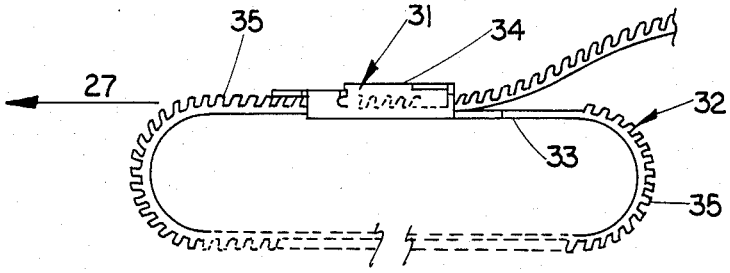

Still another embodiment of the strapping device of the present invention is illustrated in FIGS. 14 and 15. This embodiment consists of a clasping chamber shown generally at 31 which is identical to that shown at 11 in FIGS. 9, 10, 11 and 12. Attached to the clasping chamber 31 is a strap shown generally at 32, a portion of which, shown at 33, is smooth and a portion of which, extending to the end and shown at 35, is toothed. Thus, it is seen that this embodiment of the strapping device is an integral fabrication. It is used by wrapping the strap around the object to be bound, inserting the strap into and through the clasping chamber 31 and closing the cap 34. The free end of the strap projecting from the clasping chamber may be trimmed for a neat appearance. This embodiment may be provided with straps 32 of various lengths to wrap around objects of various sizes.

What is claimed is:

1. A hanging device for an object comprising:

a toothed strap with attachment means at one end;

a clasping strap with attachment means at one end thereof and means for clasping said toothed strap at the other end;

at least two identical hook elements, each including means for engaging said toothed strap attachment means and said clasping strap attachment means; and at least two cushion buttons adapted to be attached to each of said hook elements, said buttons having means to contact said object to hold said hook elements snugly against the object, and having means for preventing disengagement of said attachment means from said hook elements.

2. A hanging device as described in claim 1 wherein said toothed strap includes the following regions:

a toothed region;

an intermediate smooth region; and an expanded end region accommodating said attachment means.

3. A hanging device according to claim 1 wherein said clasping strap includes:

a clasping member;

a smooth strap extending from said clasping member; and an expanded strap region accommodating said attachment means located at the end of the smooth strap opposite the clasping member.

4. A hanging device according to claim 3 wherein said clasping member comprises:

a clasping chamber with an open top, side walls and end walls, holes centrally located in the end walls thereof which are in a plane perpendicular to the extending smooth strap, said holes being of proper dimension to accommodate passage of said toothed strap, said clasping chamber further including undercut longitudinal depressions, each undercut being located at the end of said depression adjacent said smooth extending strap; and a toothed locking cap pivotally attached to said chamber remote from the end from which said smooth strap extends, said cap including a set of teeth located in the center of said cap such that movement of said cap into contact with said chamber will cause said set of teeth to move into engagement with a said toothed strap when said toothed strap is placed within the center of the chamber and extending out of said chamber holes, said cap also including locking tabs positioned to snap into said longitudinal depressions, and further including means for gripping and pulling the cap from a closed and snapped position in which the cap teeth are engaged with the strap teeth to an open position in which the teeth are disengaged.

5. A hanging device according to claim 4 wherein each said hook element comprises a main body symmetrical about a vertical axis and defined by a top edge which intersects substantially parallel side edges, a portion converging into substantially V-shaped edges in which substantially semi-circular recesses are provided, said V-shaped edges ultimately terminating at their intersection with a bottom edge, said main body containing a keyhole shaped perforation centrally located along the vertical axis of symmetry of said main body, and further comprises at least two fingers attached to the top edge of said main body and extending outward from said main body in a direction substantially perpendicular to said main body, said fingers describing an arc greater than 90° from the main body plane whereby the entire hook element can be attached to a plate or similar thin object.

6. A hanging device according to claim 5 wherein said attachment means on said toothed strap and said clasping strap comprises a substantially circular tab rigidly held to the expanded strap region at a distance above the plane of said expanded strap region sufficient to accommodate the thickness of said hook elements by a bar shaped member sufficiently narrow to fit within the narrow tail portion of said keyhole shaped perforation, said circular tab having a diameter such that it can be passed through the circular portion of said keyhole shaped perforation and moved in the direction of said narrow tail portion thereby securing the strap to the hook element.

7. A hanging device according to claim 6 wherein the teeth of said toothed strap are parallel, evenly spaced, of even height, and provided with a radius at the tip of each tooth of between 0.01 and 0.02 inch, one side of each tooth being between 80° and 90° from the plane of the strap when measured from the side adjacent said attachment means and the other side of each tooth being between 50° and 60° when measured in the same manner whereby the forces exerted on the tooth angles help to maintain said cap on said clasping chamber in a closed position.

* * * * *